United States Patent [19]

Crowle et al.

[11] 4,002,275

[45] Jan. 11, 1977

[54] SAFETY CAP

[75] Inventors: William G. Crowle, Deerfield; Efrem M. Ostrowsky, Highland Park, both of Ill.

[73] Assignee: VCA Corporation, Baton Rouge, La.

[22] Filed: Nov. 12, 1975

[21] Appl. No.: 631,033

[52] U.S. Cl. ..... 222/543; 215/216; 222/546; 222/549

[51] Int. Cl.[2] ..... B67D 5/06

[58] Field of Search ..... 222/543, 546, 519, 545, 222/549, 551, 552; 215/211, 215, 216, 221, 214, 222

[56] References Cited

UNITED STATES PATENTS

| | | | |
|---|---|---|---|
| 3,339,770 | 9/1967 | Weigand | 215/214 |
| 3,433,394 | 3/1969 | Stull | 222/549 X |
| 3,765,578 | 10/1973 | Stull | 222/546 |
| 3,811,589 | 5/1974 | Thornton et al. | 215/9 |
| 3,896,958 | 7/1975 | Robbins et al. | 215/211 |

*Primary Examiner*—Stanley H. Tollberg
*Assistant Examiner*—Hadd Lane
*Attorney, Agent, or Firm*—Donald L. Johnson; John F. Sieberth; Edgar E. Spielman, Jr.

[57] ABSTRACT

A safety dispensing cap for fluid containers is disclosed. The cap features a tubular discharge member, a tubular closing member for attaining a rotating overlying removable fit on the discharge member and an internal latching assembly which is activated or deactivated by rotation of the tubular closing member about the tubular discharge member. The latching assembly comprises an inwardly extending latching lug on the tubular closing member and an outwardly extending latching lug on the tubular discharge member. In the locked position, the discharge latching lug will overlie the closing latching lug thus preventing removal of the closing member from the discharge member. Unlatching of the two members is achieved by a rotation of the closing member until the closing member latching lug is no longer underneath the discharge member closing lug. An indexing assembly can also be provided which will hold the unlocked position.

16 Claims, 16 Drawing Figures

SAFETY CAP

BACKGROUND OF THE INVENTION

There is a great need for simple and inexpensive safety caps which are adaptable for mass production and which cannot be easily opened by children. A need for such a safety cap is extremely important for use with containers which contain harmful fluids such as charcoal lighter fluid, lye, paint remover, insecticides, toilet bowl cleaners, etc.

A very popular safety cap being presently used is of the type disclosed in U.S. Pat. No. 3,765,578 and U.S. Pat. No. 3,848,780. These caps depend upon registry of an external tab carried by the closure portion of the cap and an external interference lug carried by the dispensing portion of the cap. When the lug and the tab are in registration, the cap is so designed that removal of the closure portion of the cap is nearly impossible with the human hand. However, children will normally use any and all available means for opening containers. It has been found, since the tab and lug are external and exposed, that children may be able to open such caps by the utilization of a sharp object to pry the closure portion from the dispensing portion or by the utilization of their own teeth to accomplish this same purpose. The external interference lug-tab system is simply not sufficient to resist this type of attack by a child.

This deficiency of the above two type caps is well recognized and the solution thereof has been attempted. In U.S. Pat. No. 3,758,000 a cap is disclosed which is said to overcome the utilization of sharp objects or teeth in opening the caps. The type cap disclosed in this patent, however, requires a multistep procedure for opening and is very complex in design, thus rendering it unacceptable from a consumer standpoint and uneconomical from a production standpoint.

In U.S. Pat. No. 3,826,394 an assembly for keeping the child from using his teeth to remove the closing member from the dispensing member is disclosed. This assembly comprises a shield which will not allow the average child's mouth to come in contact with the closure member tab. Despite this advance in the art, it is clear to see that, with the interference lug-tab relationship still existing and external to the safety cap, a child may be able to still get a sharp object between the two and pry the cap to the open position.

Therefore it is an object of this invention to provide a safety cap which cannot be pried open when in the locked position. It is another object of this invention to provide a cap having an internal tamper-proof locking assembly.

The Invention

This invention relates to a safety dispensing cap for fluid containers which comprises: a tubular discharge member, having an opening for discharging fluid from a container and having an assembly for attaching the tubular discharge member to the container; a tubular closing member, for attaining a rotating, overlying, removable fit onto the tubular discharge member, the members each having attaching assemblies for attaining such fit and the tubular closing member having a sealing assembly for sealing the opening when the fit is attained; a first latching lug carried by the tubular discharge member, the first latching lug being overlaid by the tubular closing member when the fit is attained; a second latching lug carried in the interior of and by the tubular closing member, the second latching lug cooperating with the first latching lug to lock the members together when the tubular closing member is snapped over and rotated so that the second latching lug underlies the first latching lug; and a tab connected to the tubular closing member for rotating the tubular closing member for locking and unlocking the members and for prying the tubular closing member from the tubular discharge member when the members are unlocked.

In a preferred embodiment a hinge is provided joining both members. The hinge is preferably a band of resilient material which offers some resistance to rotation of the tubular closing member so that the latching lugs are biased to stay in the locked position. To aid the user of the cap of this invention when such a resilient hinge is used, an indexing assembly may also be utilized. The indexing assembly would enable the user to rotate the tubular closing member until the second latching lug is no longer underlying the first latching lug and to remove his grip from the tubular closing member without the hinge tending to rotate the closing member back to the locked position. A particular preferred latching assembly comprises a protuberance which projects radially and outwardly from the tubular discharge member and cooperating detents positioned within the tubular closing member which are sized to accommodate the protuberance. The detents are located such that they will receive the protuberance and hold the tubular closing member in position when the second latching lug is not underlying the first latching lug.

As can be appreciated from the foregoing, the dispensing cap of this invention features ease in use and high resistance to opening by a child. Unlike prior art caps, the locking system is internal with the cap of this invention, thus preventing a child from utilizing his teeth or an object to pry the top portion of the cap from the bottom portion of the cap.

Other features contributing to use and economy in operation will become more apparent from the following description when taken in connection with the accompanying drawings in which.

Figure 1:
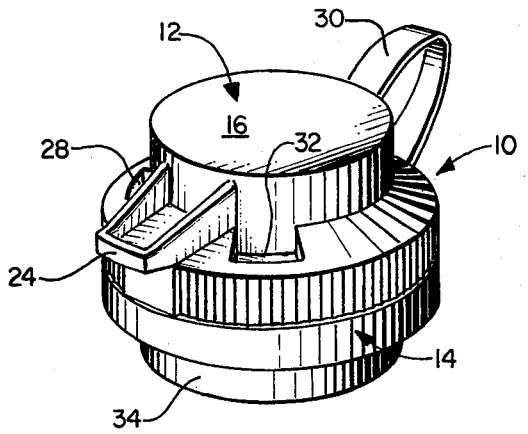
FIG. 1 is a perspective view of a dispensing cap of this invention in the locked position.
Figure 1A:
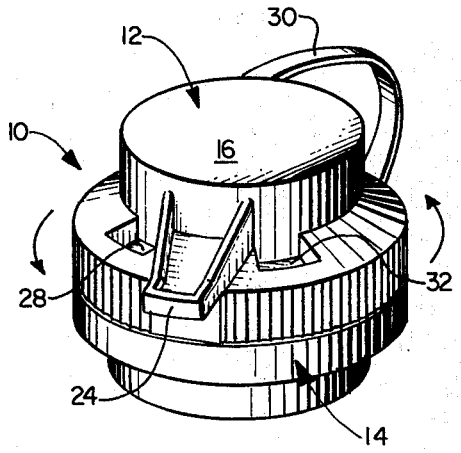
FIG. 1A is a perspective view of the cap of FIG. 1 in the unlocked position.
Figure 2:
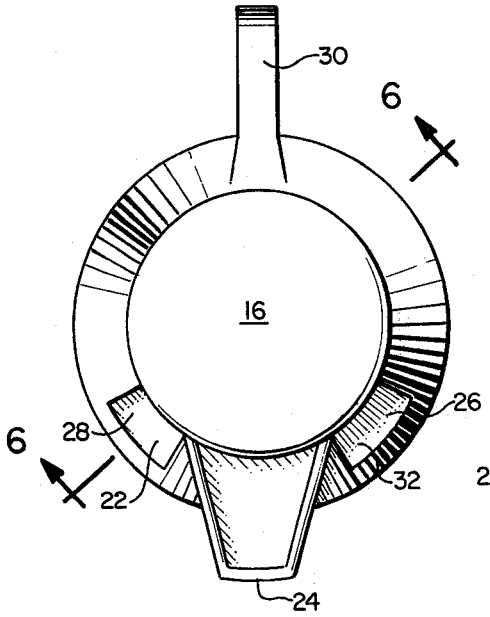
FIG. 2 is a top plan view of the cap of FIG. 1.

Referring now to FIGS. 1–6, it can be seen that in one embodiment a dispensing cap of this invention, generally designated by the numeral 10, has a tubular discharge member generally designated by the numeral 14 and a tubular closing member generally designated by the numeral 12. Tubular closing member 12 is adapted to overlie and to obtain a rotatable, removable fit on tubular discharge member 14. Depending downward from the bottom of tubular discharge member 14 is conical undercut retainer bead 34. Retainer bead 34 permanently attaches cap 10 to a container by means of a force fit.

Figure 3:
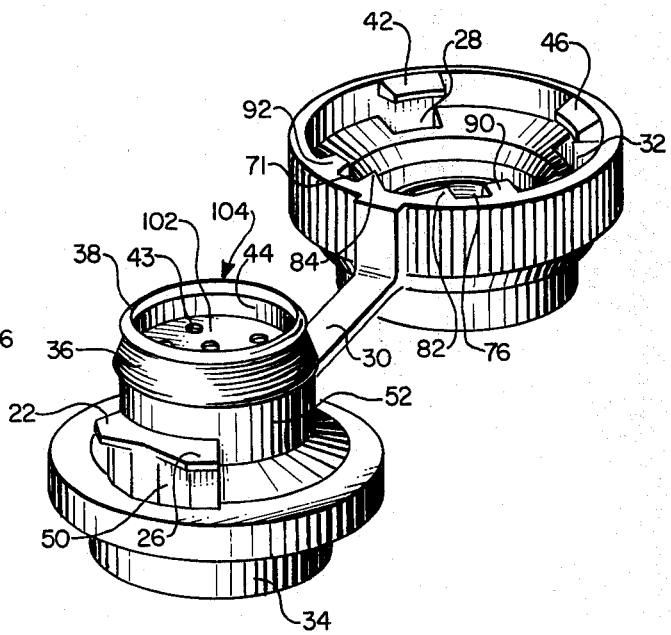
FIGS. 3 and 4 are perspective views of the cap of FIG. 1 in the open position.
Figure 4:
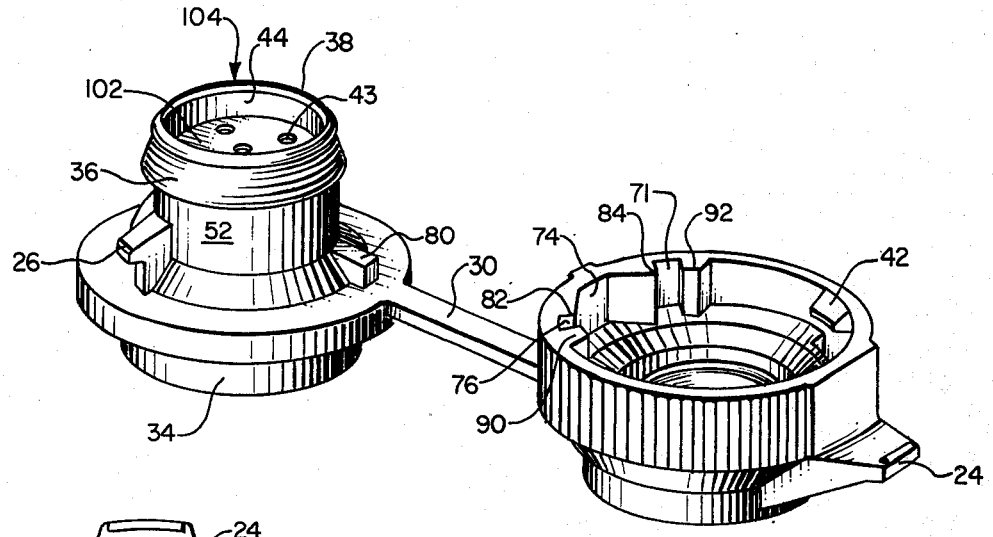
Figure 5:
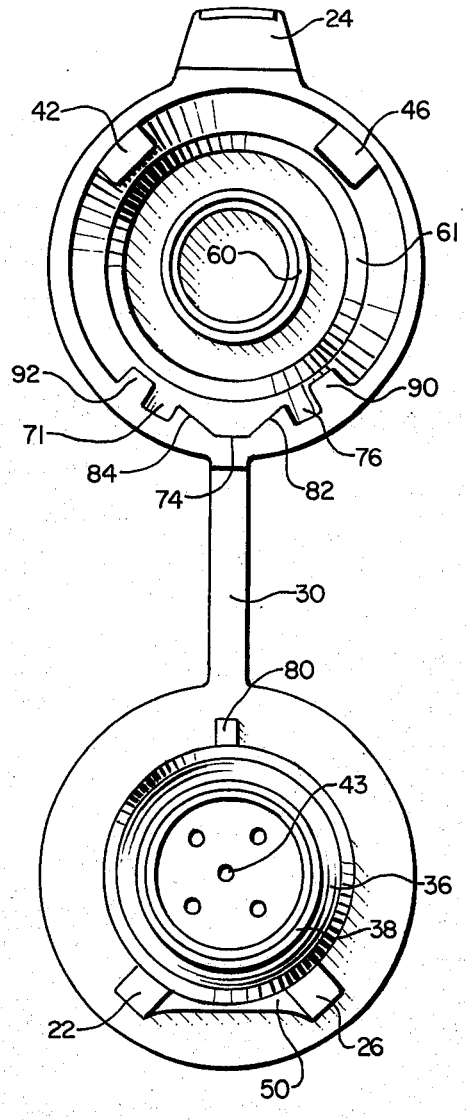
FIG. 5 is a top plan view of the cap of FIG. 1 in the open position.
Figure 6:
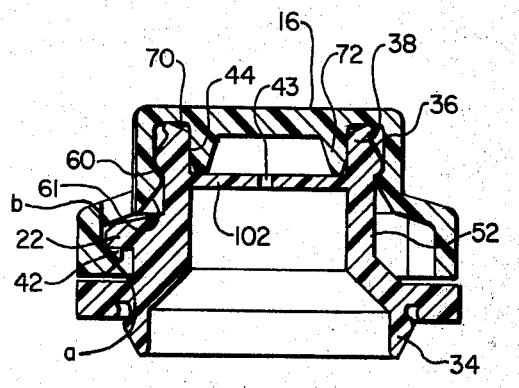
FIG. 6 is a sectional view taken along section lines 6—6 of FIG. 2.

As can be seen in FIGS. 3–6, discharge member 14 has a neck portion 52. At the upper end of neck portion 52 is undercut annular outwardly extending, conical closing bead 36. To obtain a snap fit between members 14 and 12, closing bead 36 cooperates with annular groove 60 which is formed by the undercut portion of camming surface 61 carried by closing member 12. As can be seen in FIGS. 5 and 6, camming surface 61 slopes inwardly to facilitate accommodation of closing bead 36 into closing groove 60. The snap fit allows for rotation of closing member 12 about discharge member 14 by the user applying a tangential force on tab 24 which is attached to closing member 12.

Immediately above closing head 36 is sealing lip 38 which, in conjunction with inside mouth wall 44, defines mouth 104 of discharge member 14. Fitting within discharge wall 44 is discharge disk 102 which has numerous apertures 43 therein to allow for dispensing of liquids from the container. Other dispensing structures may, of course, be utilized with the cap of this invention. For example, discharge wall 44 may be completely removed to provide a full opening for pouring contents from the container. Other dispensing assemblies might include a single small opening for providing a fine stream, or a spray orifice if the cap of this invention is utilized on a squeeze bottle. As will be hereinafter described, the cap of this invention may also be provided with a single opening having a pouring spout or with a single opening having structure to provide a 45° angled stream.

Sealing lip 38 abuts recess 70 when the cap 10 is in the closed position as is seen in FIG. 6. Fittable within mouth 104 and in abutment with mouth wall 44 is annular sealing ring 72 which depends downwardly from the inside portion of top wall 16 of closing member 12. As can be seen in FIG. 6, a liquid-tight seal is formed by sealing ring 72 abuting mouth wall 44 and/or by seating of sealing bead 38 into recess 70.

Figure 10:
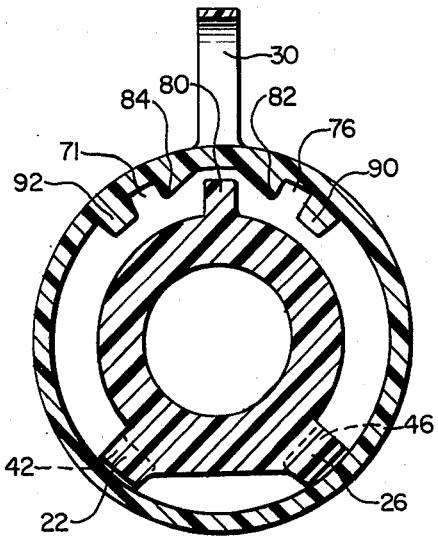
FIG. 10 is a sectional view taken along section lines 10—10 of FIG. 7.
Figure 10A:
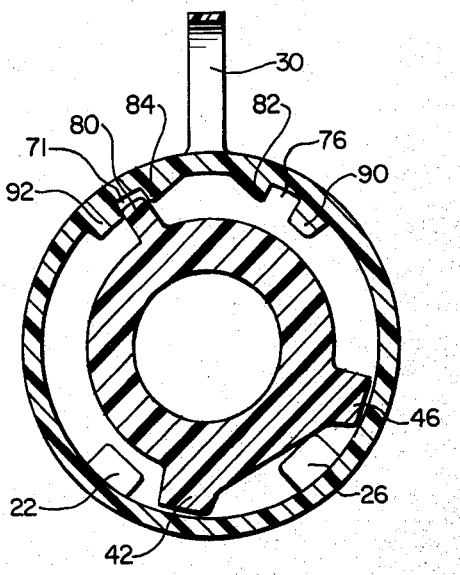
FIG. 10A is a sectional view taken along section lines 10A—10A of FIG. 8.

Locking closing member 12 and discharge member 14 together when cap 10 is in the closed position is achieved by the utilization of an internal locking assembly. Mounted on discharge member 14 are locking overlugs 22 and 26. Locking overlugs 22 and 26 are strengthened by the utilization of mount 50. As can be seen, locking overlugs 22 and 26 extend radially from and in a plane perpendicular to the center axis of cap 10. Cooperating with locking overlugs 22 and 26 are locking underlugs 42 and 46 which are carried by closing member 12. As can be seen in FIGS. 3–5, locking underlugs 42 and 46 extend radially and inwardly from the bottom portion of closing member 12. In a closed, locked position locking underlugs 42 and 46 will underlie locking overlugs 22 and 26 respectively. This locking arrangement is shown in FIGS. 6 and 10. Opening of the cap can only occur in the unlocked position, i.e. when underlugs 42 and 46 do not underlie overlugs 22 and 26 as shown in FIG. 10A.

When cap 10 is in the locked position, the indexing assembly together with hinge strap 30 maintains the locked position despite the rotation efforts of a child. Hinge strap 30 which is resilient, offers resistance to rotation as rotation of tubular closing member 12 causes deformation and twisting of hinge strap 30. The indexing assembly also offers resistance to turning due to friction between indexing lug 80 and indexing camming surfaces 84 and 82. As can be appreciated, when tubular closing member 12 is rotated indexing lug 80 must ride up either camming surface 84 or camming surface 82. At this point some deformation of tubular closing member 12 must occur to achieve rotation. As the cap of this invention is of resilient material, there is resistance offered to the deformation and thus resistance to rotation. The combined resistance to rotation offered by the indexing assembly and hinge strap is never so large as to prevent an adult from rotating closing member 12 about discharge member 14.

Another feature of the indexing assembly is to provide a means for holding closing member 12 in the unlocked position when that position is achieved so that a raising force can be applied to tab 24 to open cap 10. By mechanically maintaining the unlocked position, the indexing assembly frees the user's hands to grasp tab 24 to remove closing member 12 from discharge member 14. As can be seen in FIG. 10A, closing member 12 is maintained in the unlocked position by seating of indexing lug 80 into index notch 71 or index notch 76. Indexing stops 92 and 90 are also provided which prevent further unnecessary rotation of closing member 12 and aid the user of the cap of this invention in locating the unlocked position. When the cap is in the locked position, indexing lug 80 rests in indent 74 formed between camming surfaces 84 and 82.

Another feature of the cap illustrated which aids the user in determining whether or not the unlocked position is achieved is provided by the utilization of viewing apertures 28 and 32. When the locked position is achieved the user will view latching overlugs 22 and 26 through the viewing apertures. When the unlocked position is achieved, the user will not see the overlugs but rather he will see locking underlugs 42 and 46.

In operation, the cap of this invention is not only childproof but is also resistant to opening by the utilization of a prying tool or teeth. FIGS. 10 and 10A illustrate the locked and unlocked positions of the cap of this invention. In FIG. 10 the locked position is achieved. As illustrated, locking overlugs 22 and 26 overlie locking underlugs 42 and 46 respectively. Due to the fact that locking underlugs 42 and 46 are an integral part of closing member 12, their position underneath the overlugs will prevent removal of closing member 12 from discharge member 14. Also it should be noted that indexing lug 80 is not within either one of the index notches. In FIG. 10A the unlocked position is illustrated. As can be seen in this drawing, locking overlugs 22 and 26 are not in a position overlying locking underlugs 42 and 46 due to the rotation of closing member 12 which carries the underlugs. Also it should be noted that indexing lug 80 is seated in indexing notch 71 thus preventing counterrotation of closing member 12 and therefore maintaining the unlocked position. At this point the user can simply hold tab 24 and peel closing member 12 from discharge member 14.

Placement of closing member 12 onto discharge member 14 is simply achieved by snapping closing member 12 onto discharge member 14. No alignment of the locking lugs is required as the underlugs are able to snap under the overlugs. To aid this snapping engagement, the lugs are provided with camming surfaces thereon. As can be seen in FIG. 6, the underlugs have camming surface *a* while the overlugs have camming surface *b*.

Figure 7:
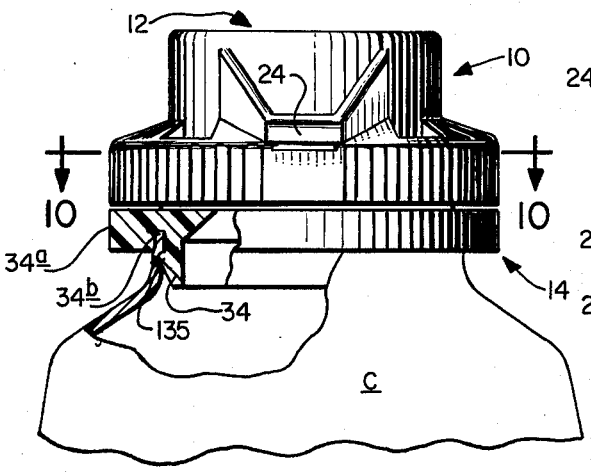
FIGS. 7, 8 and 9 are side elevational views of the cap of FIG. 1 attached to containers, each figure depicting a different attaching assembly for obtaining the attachment.
Figure 8:
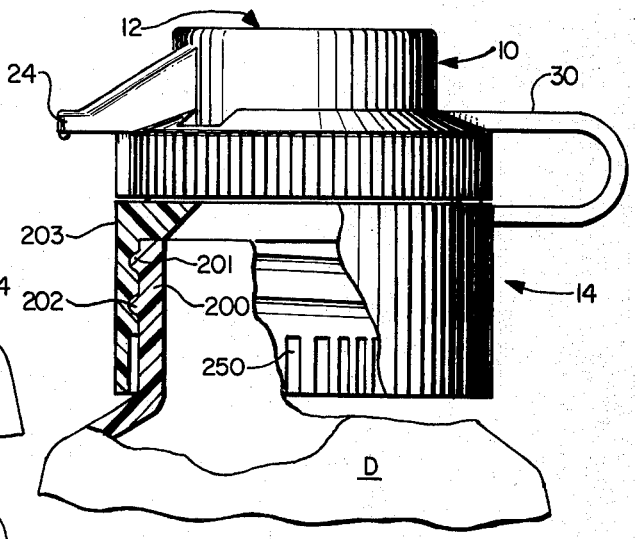
Figure 9:
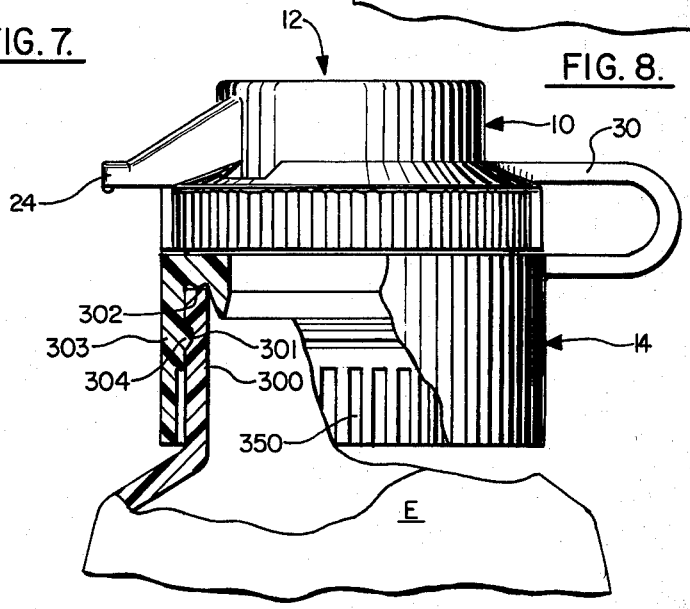

FIGS. 7–9 illustrate various ways in which a cap of this invention can be attached to a container. The attachments illustrated in FIGS. 7–9 are merely illustrative and are not to be deemed limiting. In FIG. 7 there is illustrated a mode of attachment which can be utilized for attaching the particular cap disclosed in FIGS. 1–6. With this type of attachment discharge member 14 is provided with a conical retainer bead 34 which fits into an annular groove 135 which is cut into the inside neck wall of the container C. The upper surface of the neck of container C fits into flange groove 34*b* which is carried by discharge member 34*a*. As can be appreciated, this type of fitting is highly resistant to removal from the container as there is very little way in which the snap fit can be broken from the outside.

In FIG. 8 there is shown another type of fit. With this type of fit, container D has about its neck 200 outwardly extending helical threads 201. These threads accommodate hollow helical threads 202 on depending discharge member skirt 203. Also provided on the inside of skirt 203 are anti-rotation ribs 250 which engage with like ridges on container D. Such ridges resist rotation of the cap thus preventing unscrewing of the cap by a child. In this arrangement the cap of this invention is merely screwed onto the container until the upper neck surface 205 of container D is in abutment with discharge member flange 206. In this manner a tight seal is obtained between the container and the cap.

In FIG. 9 there is depicted a cap which has a downwardly directed skirt 303 having an inwardly projecting annular protuberance 304 thereon. Protuberance 304 is sized to seat in annular groove 301 which seating attains a snap fit between groove 301 and protuberance 304. As can be seen from the drawing, groove 301 is formed into the outside wall of neck 300 of container E. At the upper surface of neck 300 is annular downwardly extending ridge 302. By having ridge 302 fit tightly onto the upper portion of neck 300 there is achieved a liquid-tight fit. Also aiding in obtaining a tight fit is retaining bead 34 which abuts the inside upper portion of neck 300.

Anti-rotation ribs 350 are provided on the inside of skirt 303. These ribs will engage like ribs on the outside surface of bottle neck 300 so that cap 10 will not rotate upon application of a tangential force on tab 24.

Figure 11:
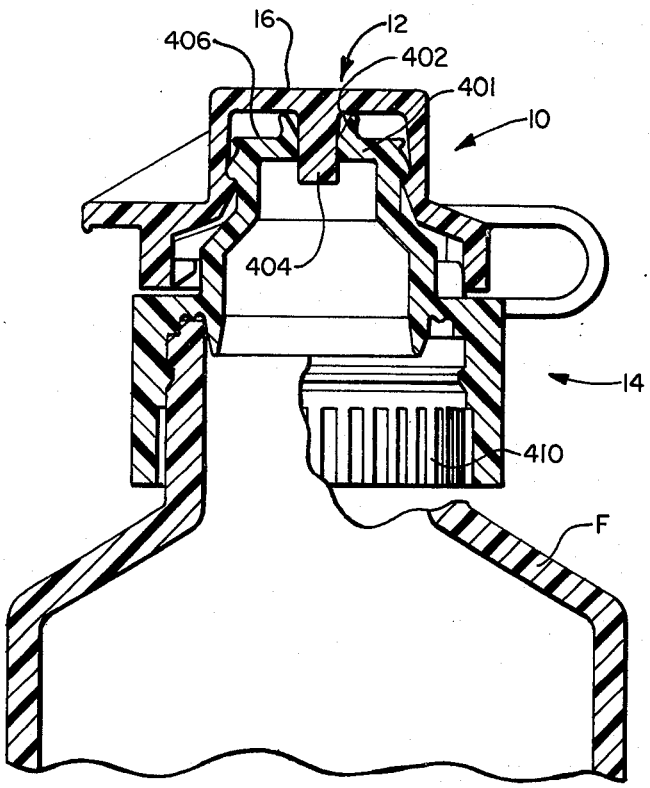
FIG. 11 is a sectional view taken through the center axis of a second dispensing cap of this invention.
Figure 12:
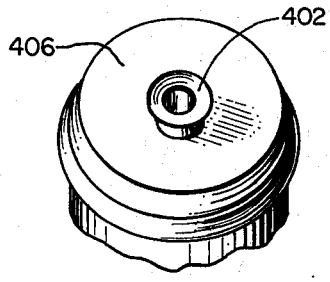
FIG. 12 is a partial perspective view of the tubular discharge member of the cap shown in FIG. 11.

In FIGS. 11–14 there is shown two further embodiments of this invention. In FIGS. 11 and 12 there is shown a cap of this invention having a dispensing assembly somewhat different from that shown for the cap of FIGS. 1–6. The cap shown in FIGS. 11 and 12 is identical to the afore-described cap except that instead of having an open mouth there is provided an end wall 406 on the tubular discharge member 14. In the center of end wall 406 is pouring spout 402 which is circular in configuration and flares outwardly from its base. The inside wall of pouring spout 402 forms an aperture through which product can be dispensed. To seal against liquid leakage, the cap of FIGS. 11 and 12 is provided with a sealing post 404 which depends downwardly from top wall 16. As can be seen in FIG. 11, sealing post 404 fits into dispensing spout 402 to achieve the seal. The description for the attachment of the cap of FIGS. 11 and 12 to bottle F with that for the attachment shown in FIG. 9.

Figure 13:
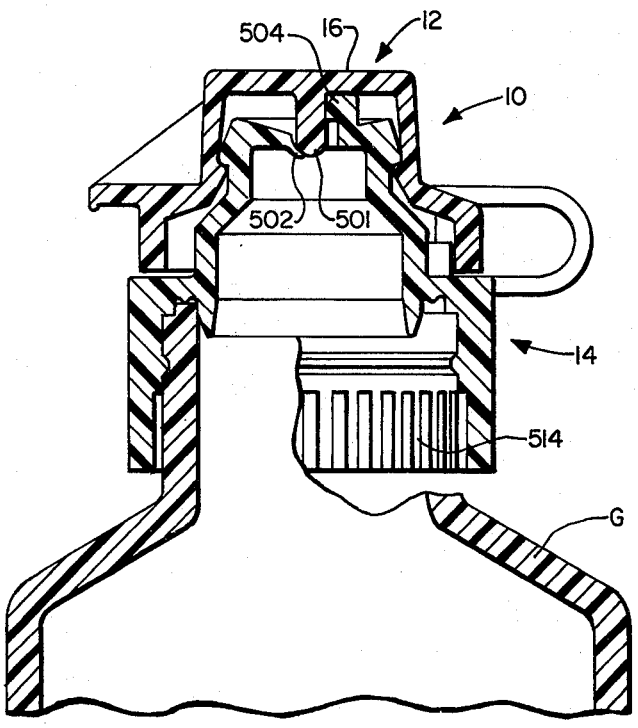
FIG. 13 is a sectional view taken along the center axis of a third cap of this invention.
Figure 14:
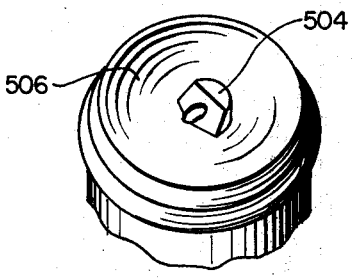
FIG. 14 is a partial perspective view of the tubular discharge member shown in FIG. 13.

In FIGS. 13 and 14 there is depicted a still further embodiment of this invention wherein the cap is identical to the one shown in FIGS. 1–6 and 9 except a different dispensing assembly is featured. In FIG. 13 it can be seen that cap 10 fits onto container G by the same means as the fit described in FIG. 9.

As can be seen from FIG. 13, tubular discharge member 14 does not have an open mouth but rather has a concave upper wall 506. At the apex of concave wall 506 there is provided aperture 510 for dispensing the contents of Container G. To direct the flow of the contents there is provided deflector 504. Deflector 504 causes the contents to leave tubular discharge member 14 at an angle, preferably 45 degrees, from the center axis of the cap. To seal aperture 510 there is provided sealing post 501 which depends downwardly from top wall 16. As can be seen from the drawing, sealing post 501 forms a seal by abutting the edge of deflector 504 and by being seated in sealing cup 502 which is formed in concave wall 506. Utilization of deflector 504, as before noted, gives a stream which leaves tubular discharge member 14 at an angle. Such a dispensing mode is useful when it is desired to apply the contents of Container G to "hard to get to" places such as the application of a toilet bowl cleanser under the lip of a conventional toilet. It should also be noted that antirotation ribs 514 are also utilized in the cap of FIG. 13 for the purposes hereinabove described for such ribs.

The cap of this invention may be made of any suitable thermoplastic such as polyethylene, polypropylene, etc. The cap of this invention can be most easily produced by the utilization of injection molding and are preferably integrally molded all in one piece.

What is claimed is:

1. A safety dispensing cap for fluid containers comprising:

a. a tubular discharge member, having an opening for discharging said fluid from said container and having container attachment means for attaching said tubular discharge member to said container;

b. a tubular closing member, for attaining a rotating, overlying, removable fit onto said tubular discharge member, said tubular closing member having a sealing means for sealing said opening when said fit is attained and said tubular closing member and said tubular discharge member having attaching means for attaining said fit, said attaching means comprising an undercut annular, outwardly extending conical closing bead carried by said discharge member and an undercut annular groove carried by said closing member, said groove snappingly receivable of said bead to attach said closing member to said discharge member;

c. a first latching lug connected to said tubular discharge member, said first latching lug being overlaid by said tubular closing member when said fit is attained;

d. a second latching lug in the interior of and connected to said tubular closing member, said second latching lug cooperating with said first latching lug to lock said members together when said second latching lug underlies said first latching lug; and e. tab means connected to said tubular closing member for rotating said tubular closing member to lock and unlock the members and for pulling said tubular closing member from said tubular discharge member when said members are unlocked.

2. The safety cap of claim 1 wherein said first latching lug has a downwardly facing planar surface substantially perpendicular to the center axis of said cap.

3. The cap of claim 1 wherein said second latching lug has a planar surface facing upward and substantially perpendicular to the center axis of said cap.

4. The cap of claim 1 wherein said first latching lug has a downwardly facing planar surface substantially perpendicular to the center axis of said cap and said second latching lug has a planar surface facing upward and substantially perpendicular to the center axis of said cap.

5. The cap of claim 1 wherein said discharge member and said closing member are permanently connected one to the other by means of a hinge.

6. The cap of claim 5 wherein said hinge is a resilient strap.

7. The cap of claim 1 wherein said opening is an aperture formed by the inside wall of a pouring spout carried by said discharge member.

8. A safety dispensing cap for fluid containers comprising:

a. a tubular discharge member having an aperture formed by the inside wall of a pouring spout carried by said discharge member for discharging said fluid from said container and said tubular discharge member having container attachment means for attaching it to said container;

b. a tubular closing member, for attaining a rotating overlying removable fit onto said tubular discharge member, said tubular discharge and said tubular closing members each having attaching means for attaining said fit and said tubular closing member having a post which is sealingly fittable within said aperture for sealing said aperture when said fit is attained;

c. a first latching lug connected to said tubular discharge member, said first latching lug being overlaid by said tubular closing member when said fit is attained;

d. a second latching lug in the interior of and connected to said tubular closing member, said second latching lug cooperating with said first latching lug to lock said members together when said second latching lug underlies said first latching lug; and e. tab means connected to said tubular closing member for rotating said tubular closing member to lock and unlock the members and for pulling said tubular closing member from said tubular discharge member when said members are unlocked.

9. The cap of claim 8 wherein said first latching lug has a downwardly facing planar surface substantially perpendicular to the center axis of said cap and said second latching lug has a planar surface facing upward and substantially perpendicular to the center axis of said cap.

10. The cap of claim 9 wherein said attaching means comprises an undercut annular outwardly extending conical closing bead carried by said discharge member and an undercut annular groove carried by said closing member, said groove snappingly receiving said bead to attach said closing member to said discharge member.

11. The cap of claim 9 wherein said discharge member and said closing member are permanently connected one to the other by means of a hinge.

12. A safety dispensing cap for fluid containers comprising:

a. a tubular discharge member having a hollow neck portion, a discharge aperture in a concave top wall carried within said neck and a container attachment means for attaching said tubular discharge member to said container, said concave wall having integrally formed therewith a deflector adjacent to said aperture to deflect the path of said fluid as it is discharged through said aperture;

b. a tubular closing member, for attaining a rotating overlying removable fit onto said tubular discharge member, said members each having attaching means for attaining said fit and said tubular closing member having a downwardly extending post sealingly fittable within said aperture for sealing same when said fit is attained;

c. a first latching lug connected to said tubular discharge member, said first latching lug being overlaid by said tubular closing member when said fit is attained;

d. a second latching lug in the interior of and connected to said tubular closing member, said second latching lug cooperating with said first latching lug to lock said members together when said second latching lug underlies said first latching lug; and e. tab means connected to said tubular closing member for rotating said tubular closing member to lock and unlock the members and for pulling said tubular closing member from said tubular discharge member when said members are unlocked.

13. The cap of claim 12 wherein said first latching lug has a downwardly facing planar surface substantially perpendicular to the center axis of said cap and said second latching lug has a planr surface facing upward and substantially perpendicular to the center axis of said cap.

14. The cap of claim 12 wherein said attaching means comprises an undercut annular outwardly extending conical closing bead carried by said discharge member and an undercut annular groove carried by said closing member, said groove snappingly receiving said bead to attach said closing member to said discharge member.

15. The cap of claim 12 wherein said discharge member and said closing member are permanently connected one to the other by means of a hinge.

16. The cap of claim 15 wherein said tubular discharge member has integrally formed with said container attachment means a hollow neck portion defining a discharge mouth and a discharge disk within said neck portion closing off said mouth, said disk having at least one aperture therein to serve as said opening.

* * * * *